US005718348A

United States Patent [19]

Manera

[11] Patent Number: 5,718,348

[45] Date of Patent: Feb. 17, 1998

[54] OVERCAP ASSEMBLY FOR GEAR FINISH VIAL

[75] Inventor: David A. Manera, Vineland, N.J.

[73] Assignee: Comar, Inc., Buena, N.J.

[21] Appl. No.: 713,028

[22] Filed: Sep. 12, 1996

[51] Int. Cl.[6] ..... B65D 51/18

[52] U.S. Cl. ..... 215/249; 215/43; 215/DIG. 3

[58] Field of Search ..... 215/247, 249, 215/43, DIG. 3

[56] References Cited

U.S. PATENT DOCUMENTS

| | | | |
|---|---|---|---|
| D. 355,606 | 2/1995 | Manera . | |
| 4,205,754 | 6/1980 | Nielsen et al. | 215/249 |
| 4,306,357 | 12/1981 | Villarevos . | |
| 4,416,661 | 11/1983 | Norman et al. | 215/247 X |
| 5,088,612 | 2/1992 | Storar et al. | 215/247 |
| 5,143,236 | 9/1992 | Gueret | 215/311 |
| 5,314,084 | 5/1994 | Folta et al. . | |
| 5,522,518 | 6/1996 | Konrad et al. | 215/247 |
| 5,598,938 | 2/1997 | Rizzardi | 215/249 |

*Primary Examiner*—Stephen Cronin
*Attorney, Agent, or Firm*—Brady, O'Boyle & Gates

[57] ABSTRACT

An overcap assembly for a gear finish vial having a cap constructed and arranged to contain either a stopper-type closure or a sealing disc closure. A plurality of radially inwardly extending ribs are provided in the cap to maintain the closure in the cap and to cooperate with teeth on the gear finish to prevent turning of the cap assembly when in the sealing position on the vial. A plurality of inwardly extending tabs are provided on the lower end of the cap for selectively engaging shoulders on the vial neck for holding the overcap assembly upwardly from the neck of the vial in an unsealed position during the lyophilization procedure and downwardly on the neck of the vial when in the sealed position.

10 Claims, 2 Drawing Sheets

OVERCAP ASSEMBLY FOR GEAR FINISH VIAL

BACKGROUND OF THE INVENTION

Various overcaps have been proposed for holding rubber stoppers or sealing discs for packaging medicaments in glass vials. Many of these overcaps are constructed and arranged to hold either a rubber stopper or sealing disc above the open end of the vial during a lyophilization procedure, followed by insertion of the stopper into or forcing the sealing disc against the open end of the vial. While these overcaps have been satisfactory for their intended purpose, they have been characterized by certain disadvantages in that different overcaps would have to be employed when using rubber stoppers and when using sealing discs.

To overcome the disadvantage of employing different overcaps for different types of closures the overcap of the present invention has been devised.

SUMMARY OF THE INVENTION

The overcap assembly of the present invention comprises, essentially, a cap having a top wall and a skirt depending therefrom. The top wall is provided with an opening for receiving a tamper-evident dust cover. A plurality of inwardly and upwardly extending tabs are integral with the lower end of the skirt for engaging a selected shoulder on the vial during a lyophilization procedure and for sealing the overcap on the vial. The inwardly and upwardly extending tabs are flexible, to thereby minimize the force required to push the overcap assembly to the sealed position on the vial at the conclusion of the lyophilization process. The portion of the overcap at the junction of the upper end portion of the skirt and the top wall provides a recessed corner for selectively receiving the flange portion of a rubber stopper on the outer peripheral portion of a sealing disc. The flange of the rubber stopper or peripheral edge of the sealing disc is held in the recessed corner by a plurality of radially inwardly extending ribs integral with the inner wall surface of the skirt and positioned below the corner. The ribs not only hold the stopper or sealing disc in the overcap but also they are adapted to be inserted between th teeth of a gear finish vial when the overcap is moved to the sealing position on the vial, to thereby prevent the overcap from turning.

DESCRIPTION OF THE PREFERRED EMBODIMENTS

Figure 1:
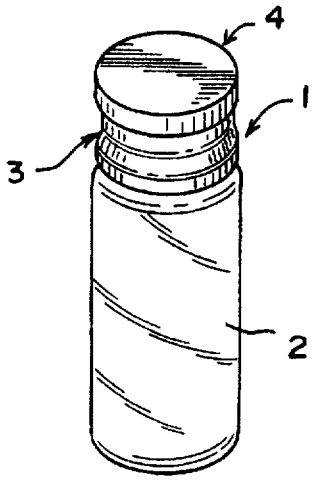
FIG. 1 is a perspective view of the overcap of the present invention secured to a vial.
Figure 2:
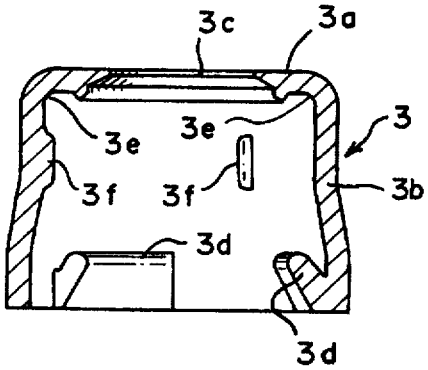
FIG. 2 is a side elevational view, partly in section, of the overcap of the present invention.
Figure 3:
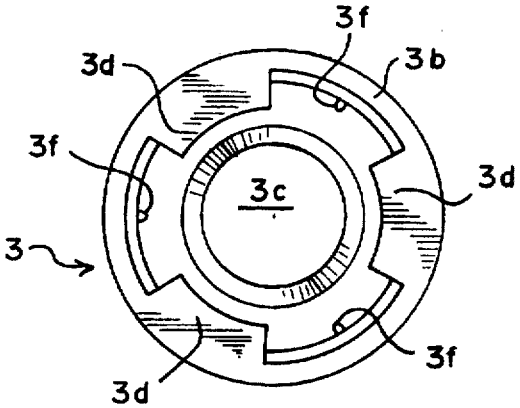
FIG. 3 is a bottom plan view of the overcap shown in FIG. 2.

Referring to FIGS. 1 and 2, the overcap assembly 1 of the present invention is adapted for sealing a glass vial 2 and includes a cap 3 having a tamper-evident dust cover 4. The cap 3 has a top wall 3*a* and a skirt portion 3*b* depending therefrom. The top wall 3*a* is provided with an opening 3*c* for holding the dust cover 4 thereon. The lower end of the skirt portion 3*b* is provided with a plurality of integral, inwardly, and upwardly extending tabs 3*d* securing the cap to the neck of the vial 2, to be described more fully hereinafter. A recessed corner 3*e* is provided at the juncture of the upper end portion of the skirt 3*b* and the top wall 3*d*, and a plurality of radially inwardly extending ribs 3*f* are integral with the inner surface of the skirt 3*b* and positioned below the corner 3*e*.

Figure 4:
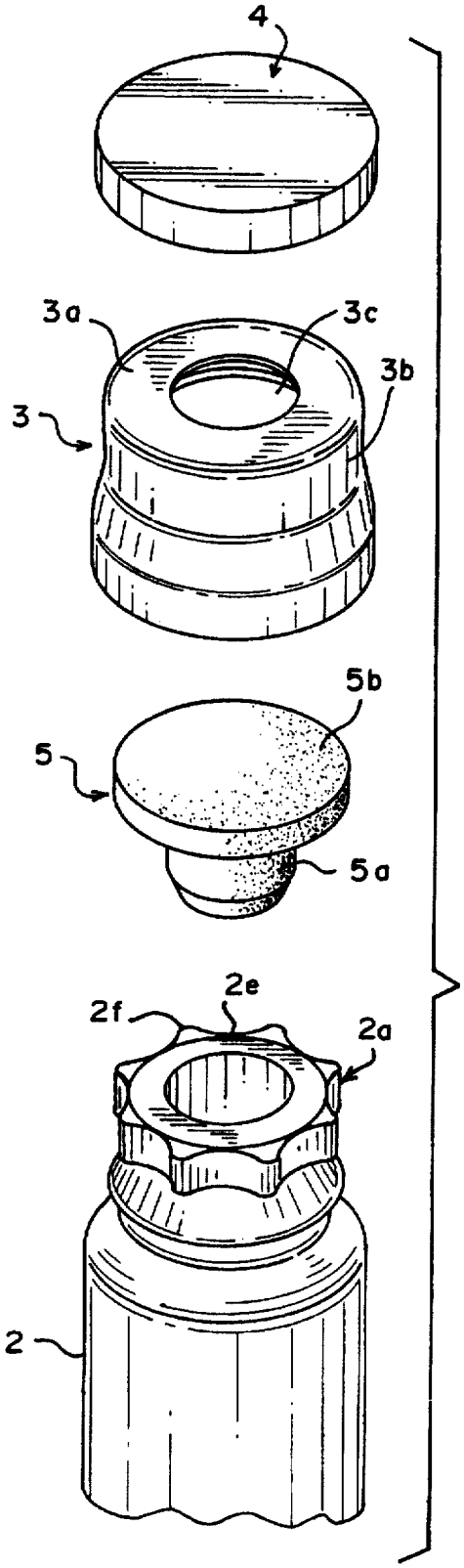
FIG. 4 is an exploded view showing a tamper evident dust cover, the overcap of the present invention, a stopper, and a vial having a gear finish.
Figure 6:
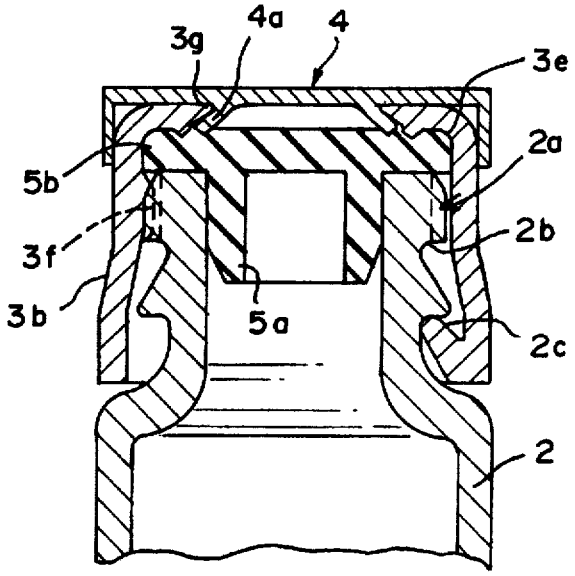
FIG. 6 is a sectional side elevational view of the assembled components shown in FIG. 4 mounted in the sealed position on a vial.

As will be seen in FIGS. 4 and 6, the cap 3 is adapted to hold a stopper-type closure 5 having a plug portion 5*a* and a flanged portion 5*b*, wherein the peripheral edge portion thereof is contained within the recessed corner 3*e* and is maintained therein by the ribs 3*f* engaging the bottom surface of the flange portion 5*b*.

The cap 3 is adapted for mounting on a vial 2 having a gear finish 2*a* and a pair of axially spaced annular shoulders 2*b*, 2*c* integral with the neck of the vial and extending radially outwardly therefrom, the neck having an outwardly flared portion 2*d* between the spaced shoulders 2*b*, 2*c*.

Figure 5:
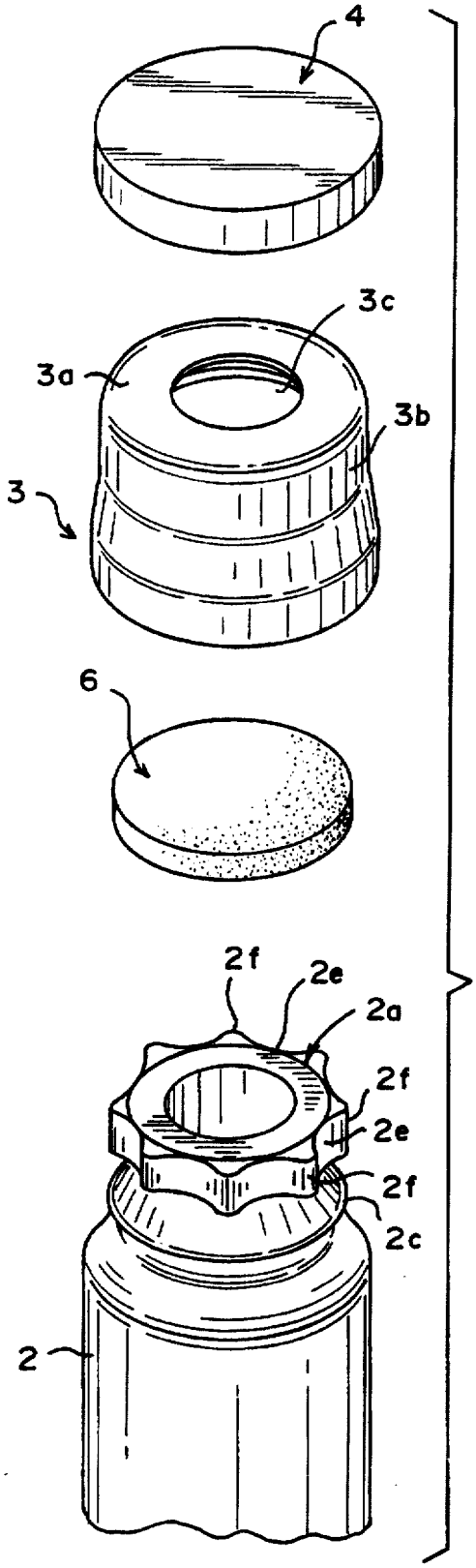
FIG. 5 is an exploded view showing a tamper evident dust cover, the overcap of the present invention, sealing disc, and a vial having a gear finish.
Figure 7:
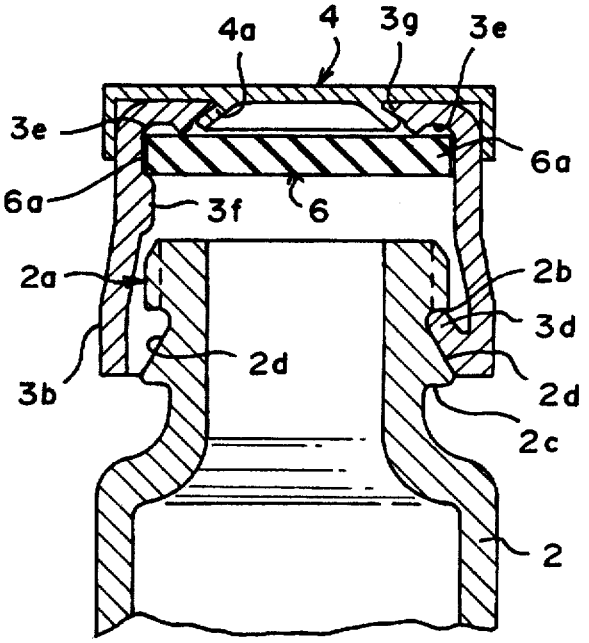
FIG. 7 is a sectional side elevational view of the assembled components shown in FIG. 5 mounted on a vial during a lyophilization procedure.

While FIGS. 4 and 6 show the cap 3 holding a stopper-type closure 5, FIGS. 5 and 7 show the cap 3 holding a sealing disc 6 wherein the peripheral edge portion 6*a* of the sealing disc is positioned in the recessed corner 3*e* of the cap 3, and maintained therein by the ribs 3*f* engaging the bottom surface of the peripheral edge portion 6*a*.

To complete the structure of the overcap assembly 1, as will be seen in FIGS. 6 and 7, the dust cover 4 is provided with an outwardly flared annular flange 4*a* adapted to be inserted into the cap opening 3*c* and snapped underneath the peripheral edge portion 3*g* of the top wall 3*a* surrounding the opening 3*c*. The top wall 3*a* is also provided with a depending annular knife edge 3*h* adjacent the peripheral edge portion 3*g* which is adapted to be pressed into both the flange portion 5*b* of the stopper-type closure 5 or the peripheral edge portion 6*a* of the sealing disc when the overcap assembly 10 is mounted in the sealed position on the vial.

In use, a dust cover 4 is snapped onto the cap 3, and either a stopper-type closure 5 or sealing disc 6 is inserted into the cap 3 from the lower end of the skirt portion 3*b* and pushed upwardly until the flange portion 5 of the stopper 5 or peripheral edge portion 6*a* of the sealing disc extends beyond the ribs 3*f*, whereby the ribs 3*f* prevent the stopper 5 on disc 6 from falling out of the cap 3. During the lyophilization procedure, the cap assembly 1 will be positioned on the neck of the vial with the tabs 3*d* engaging the flared portion 2*d* of the vial neck and the shoulder 2*b*, as shown in FIG. 7. After the lyophilization procedure has been completed, the overcap assembly 1 is pressed downwardly onto the open end of the vial, whereby the flange portion 5*b* of the stopper 5 or peripheral edge 6*a* of the sealing disc is lifted off the ribs 3*f* and pressed into the recessed corner 3*e* of the cap. The ribs 3*f* are moved downwardly onto the gear finish 3 and become positioned in the space 2*e* between adjacent teeth 2*f* to thereby prevent the cap assembly from turning once mounted in the sealed position on the vial.

In order that the cap assembly 1 need not be oriented any special way to ensure that the ribs 3*f* will become positioned in the spaces 2*e* between adjacent teeth 2*f*, the cap 3 is provided with three ribs 3*f*, and the vial finish 2*a* is provided with eight teeth 2*f*. By this construction and arrangement, at least two of the ribs 3*f* enter a respective space 2*e* between adjacent teeth 2f, while the third rib 3f will be destroyed when the cap 3 is pushed onto the vial 2.

From the above description, it will be readily apparent to those skilled in the art that the overcap assembly of the present invention is an improvement over heretofore employed overcap assemblies in that the cap 3 of the present invention is constructed and arranged to accommodate either a stopper-type closure 5 or a sealing disc closure 6, and the ribs 3f not only hold the closure in the cap 3 but also cooperate with the gear finish 2a to prevent the overcap assembly from turning while in the sealed position.

It is to be understood that the form of the invention herewith shown and described is to be taken as a preferred example of the same, and that various changes in the shape, size, and arrangement of parts may be resorted to, without departing from, the spirit of the invention or scope of the subjoined claims.

I claim:

1. The combination of an overcap assembly and a vial having a neck and a plurality of teeth providing a gear finish on said neck, said overcap assembly comprising a cap, said cap having a top wall, a skirt portion depending from said top wall, a recessed corner at the juncture of the upper end portion of said skirt and said top wall, a plurality of radially inwardly extending ribs integral with the inner surface of said skirt portion, said ribs being positioned below said recessed corner, a closure mounted within said cap and supported by said ribs, and means for connecting the cap to the neck of said vial, portions of said ribs extending between the teeth of the gear finish when the overcap assembly is mounted in a sealed position on the vial.

2. The combination according to claim 1, wherein the gear finish has at least eight teeth, and said cap has at least three ribs, whereby at least two ribs enter a respective space between said teeth, whereby the necessity of orientating the cap assembly relative to the vial prior to lyophilization is precluded.

3. The combination of an overcap assembly and a vial having a neck and a shoulder on aid neck, said shoulder having a bottom surface, said overcap assembly comprising a cap, said cap having a top wall, a skirt portion depending from said top wall, a recessed corner at the juncture of the upper end portion of said skirt and said top wall, a plurality of radially inwardly extending ribs integral with the inner surface of said skirt portion said ribs being positioned below said recessed corner, a closure mounted within said cap and supported by said ribs, and a plurality of inwardly and upwardly extending tabs integral with the lower end portion of said skirt portion, said tabs engaging the bottom surface of said shoulder, whereby the cap is connected to the vial.

4. The combination according to claim 3, wherein the closure comprises a stopper having a flange portion and a depending plug portion integral therewith, the flange portion having a peripheral edge portion contained within said recessed corner and supported by said ribs.

5. The combination according to claim 3, wherein the closure comprises a sealing disc having a peripheral edge portion, the peripheral edge portion of said disc contained within said recessed corner.

6. The combination according to claim 3, wherein a pair of axially spaced shoulders are integral with the neck of said vial and extend radially outwardly therefrom, an outwardly flared portion on said neck between said shoulders, the tabs engaging said flared portion and the bottom surface of the upper shoulder, whereby the overcap assembly is held above the open end of the vial during the lyophilization procedure, the tabs engaging the bottom surface of the lower shoulder when the overcap assembly is mounted in the sealed position on the vial.

7. The combination according to claim 6, wherein the tabs are flexible, to thereby minimize the force required to push the overcap assembly to the sealed position on said vial.

8. The combination according to claim 3, wherein a tamper-evident dust cover is mounted on the top wall of said cap.

9. The combination according to claim 8, wherein an opening is provided in the top wall of said cap, a depending, flared annular flange integral with the bottom surface of said cover, said flange inserted through said opening and engaging the peripheral edge portion of the bottom surface of the top wall adjacent to the opening.

10. An overcap assembly according to claim 9, wherein a depending annular knife edge is integral with the bottom surface of the top wall adjacent said peripheral edge portion, said knife edge being pressed into the closure when mounted in the sealed position on a vial.

* * * * *